US011384502B2

(12) United States Patent
Wang et al.

(10) Patent No.: US 11,384,502 B2
(45) Date of Patent: Jul. 12, 2022

(54) CONCRETE INSIDE INTERFACE PROCESSING STRUCTURE AND METHOD FOR SECANT PILE CONSTRUCTION

(71) Applicants: QINGDAO UNIVERSITY OF TECHNOLOGY, Qingdao (CN); Qingdao Green Technology Geotechnical Engineering Co., Ltd., Qingdao (CN); Zhongqing Jian'an Construction Group Co., Ltd., Qingdao (CN)

(72) Inventors: Yonghong Wang, Qingdao (CN); Bo Han, Qingdao (CN); Jian Huang, Qingdao (CN); Qijun Zhang, Qingdao (CN); Jiangbin Wu, Qingdao (CN); Wengang Zhang, Qingdao (CN); Peiyuan Lin, Qingdao (CN); Junning Xiang, Qingdao (CN); Jun Yan, Qingdao (CN); Bin Wang, Qingdao (CN); Wenzhuo Liu, Qingdao (CN); Chengyue Jia, Qingdao (CN); Xiang Fang, Qingdao (CN); Xin Wang, Qingdao (CN); Zuodong Liang, Qingdao (CN)

( * ) Notice: Subject to any disclaimer, the term of this patent is extended or adjusted under 35 U.S.C. 154(b) by 0 days.

(21) Appl. No.: 17/581,911

(22) Filed: Jan. 22, 2022

(65) Prior Publication Data

US 2022/0145568 A1 May 12, 2022

Related U.S. Application Data

(63) Continuation of application No. PCT/CN2020/103601, filed on Jul. 22, 2020.

(30) Foreign Application Priority Data

Jul. 24, 2019 (CN) ..... 201910669392.3

(51) Int. Cl.
*E02D 17/04* (2006.01)
*E02D 5/46* (2006.01)
(Continued)

(52) U.S. Cl.
CPC ..... *E02D 17/04* (2013.01); *E02D 5/30* (2013.01); *E02D 5/46* (2013.01); *E02D 19/18* (2013.01)

(58) Field of Classification Search
CPC combination set(s) only.
See application file for complete search history.

(56) References Cited

U.S. PATENT DOCUMENTS

2014/0050531 A1* 2/2014 Mancini ..... E21D 1/00 405/133
2019/0309497 A1* 10/2019 Curtis ..... E21D 9/04

FOREIGN PATENT DOCUMENTS

CN 204112372 U 1/2015
CN 106894422 A 6/2017
(Continued)

OTHER PUBLICATIONS

Internation Search Report of PCT/CN2020/103601, dated Oct. 28, 2020.

*Primary Examiner* — Kyle Armstrong

(57) ABSTRACT

A concrete inside interface processing structure for secant pile construction, including secant concrete pile, formed plain concrete pile, rotary jet grouting piles, steel mesh sheet, ribbed steel bar, Y-shaped connecting piece, reinforced concrete pile, and U-shaped connecting piece; drilled holes are arranged at intervals along axis of the formed plain concrete pile; the ribbed steel bar is anchored in each drilled hole; the steel mesh sheet is formed by connecting longitudinal bars and transverse bars, and driven into a soil body between the formed plain concrete piles; the concrete layer is formed by spraying concrete on the steel mesh sheet; the
(Continued)

reinforced concrete pile is cast at outside of the formed plain concrete pile, and tangent to the formed plain concrete pile, and interlocked with the rotary jet grouting piles; the rotary jet grouting piles are tangent to the formed plain concrete pile or secant concrete pile.

10 Claims, 4 Drawing Sheets

(51) Int. Cl.
*E02D 5/30* (2006.01)
*E02D 19/18* (2006.01)

(56) References Cited

FOREIGN PATENT DOCUMENTS

| | | | | | |
|---|---|---|---|---|---|
| CN | 109778917 | A | | 5/2019 | |
| CN | 109914390 | A | | 6/2019 | |
| CN | 110670598 | A | | 1/2020 | |
| CN | 211171995 | U | | 8/2020 | |
| GB | 2403977 | A | * | 1/2005 | ..... E02D 5/10 |
| KR | 20100127402 | A | * | 12/2010 | |
| KR | 101034853 | B1 | | 5/2011 | |
| KR | 20130047719 | A1 | | 5/2013 | |
| KR | 101447140 | B1 | * | 10/2014 | |
| WO | 2010134731 | A9 | | 3/2011 | |

* cited by examiner

CONCRETE INSIDE INTERFACE PROCESSING STRUCTURE AND METHOD FOR SECANT PILE CONSTRUCTION

CROSS-REFERENCE TO RELATED APPLICATIONS

This application is a continuation of International Patent Application No. PCT/CN2020/103601 with a filing date of Jul. 22, 2020, designating the United States, and further claims priority to Chinese Patent Application No. 201910669392.3 with a filing date of Jul. 24, 2019. The content of the aforementioned applications, including any intervening amendments thereto, are incorporated herein by reference.

TECHNICAL FIELD

The present disclosure relates to the field of construction engineering, and in particular relates to a concrete inside interface processing structure of secant pile construction during foundation pit construction and a method for making the same.

BACKGROUND

Secant pile wall is an integral continuous waterproof and soil, retaining structure with good impermeability formed by overlapping part around the circumference between adjacent concrete piles and inserting reinforcing cage into the pile constructed in successive phases. The secant pile wall widely used in foundation pit engineering due to its outstanding advantages. However, during the construction of the secant pile wall, the construction will be interrupted due to unforeseen factors such as weather, mechanical failure, and construction errors, such that the construction of the secant pile wall will be delayed and concrete inside interfaces are further generated. The concrete inside interface of the secant pile wall will seriously affect the integrity and anti-leakage of the foundation pit. At present, the anti-seepage and anti-leakage performance of pile back reinforcement method needs to be improved. Therefore, it is urgent to design a concrete inside interface processing structure and method for secant pile wall construction.

SUMMARY

The objective of the present disclosure is to overcome the shortcomings of the prior art, and provide a concrete inside interface processing structure and method for secant pile construction, so as to further improve the overall stability of secant pile and the anti-leakage at the concrete inside interface.

In order to achieve the above object, the technical solution adopted in the present disclosure is as follows.

For a first aspect, a concrete inside interface processing structure for secant pile construction is provided, the structure includes a secant concrete pile, a formed plain concrete pile, a plurality of rotary jet grouting, piles, a steel mesh sheet, a ribbed steel bar, a concrete layer, a Y-shaped connecting piece, a reinforced concrete pile, a soil body between formed plain concrete piles, a bar glue, and a U-shaped connecting piece;

drilled holes are arranged at intervals along an axis of the formed plain concrete pile;

the steel mesh sheet is formed by connecting longitudinal bars and transverse bars, connection joints between the longitudinal bars and transverse bars are steel mesh sheet nodes; steel mesh sheet nodes located on both sides of the steel mesh sheet are connected with ends of the Y-shaped connecting piece, tail portion of the Y-shaped connecting piece is connected with the ribbed steel bar, the ribbed steel bar is anchored in each drilled hole; and steel mesh sheet nodes in middle of the steel mesh sheet are connected with the U-shaped connecting piece; the steel mesh sheet is driven into a soil body between the formed plain concrete piles, and the concrete layer is formed by spraying concrete on the steel mesh sheet; the reinforced concrete pile is cast at an outside of the formed plain concrete pile; and the reinforced concrete pile is tangent to the formed plain concrete pile, a reinforcement depth of the reinforced concrete pile is an elevation from a ground to a bottom of the secant concrete pile; and the reinforced concrete pile is interlocked with the rotary jet grouting piles; the plurality of rotary jet grouting piles are tangent to the formed plain concrete pile or the secant concrete pile; a reinforcement depth of the rotary jet grouting pile is an elevation from a ground to a bottom of the secant concrete pile.

Further, each of two branch ends of the Y-shaped connecting piece is provided, with a hook, the two hooks are bent 180° to same side, an inner diameter of the hook is slightly larger than that of the ribbed steel bar connected; an angle between the two branch ends is 45°.

Further, the drilled holes are evenly arranged along a length direction of the formed plain concrete pile.

Further, lengths of two sides of the U-shaped connecting piece are unequal, two ends of the U-shaped connecting piece are sharp ends, and an inner diameter of a curved part of the U-shaped connecting piece is slightly larger than that of the ribbed steel bar connected.

Further, a diameter of the rotary jet grouting pile is same as that of the secant concrete pile.

For a second aspect, a processing method of concrete inside interface in secant, pile construction is provides, the method includes:

step 1: cleaning up a sprayed surface; removing a loose part of a soil body at an interface between enclosure piles according to an excavation sequence of a foundation pit, after excavating each layer of soil between formed plain concrete piles;

step 2: drilling holes with a vertical spacing on each formed plain concrete pile along an axis direction of each formed plain concrete pile; welding a ribbed steel bar and a Y-shaped connecting piece together and anchoring the ribbed steel bar and the Y-shaped connecting piece on the formed plain concrete piles by a bar glue;

step 3: preparing a steel mesh sheet;

step 4: installing the steel mesh sheet; wherein the sprayed surface is ensured flat before hanging the steel mesh sheet, and steel mesh sheet nodes on both sides of the steel mesh sheet are hanged to two hooks of the Y-shaped connecting piece to make a connection of the steel mesh sheet and the Y-shaped connecting piece firm;

step 5: driving a U-shaped connecting piece into the sprayed surface after the U-shaped connecting piece is connected with middle nodes of the steel mesh sheet to firmly fix the steel mesh sheet to the soil, body between the formed plain concrete piles;

step 6: spraying concrete; wherein spraying operation is carried out in sections, zones and layers from top to bottom in sequence;

step 7: repeating steps 2 to 6; wherein double layers of steel mesh sheet are used between the formed plain concrete piles, the concrete is sprayed in layers, and a concrete layer is finally formed;

step 8: constructing a reinforced concrete pile; leveling a site and setting out lines for positioning; constructing a concrete guide wall on a top of the reinforced concrete pile; positioning a drilling machine after a strength of the concrete guide wall meets a requirement; removing soil to form a pile hole and placing a steel reinforcement cage into the pile hole; grouting concrete by grouting pipe, and pulling out the grouting pipe to complete a construction of the pile hole;

step 9: constructing of rotary jet grouting piles; adding four rotary jet grouting piles with same diameter as the reinforced concrete pile on both sides of the reinforced concrete pile; wherein the rotary jet grouting piles interlock with the reinforced concrete pile and are tangent to the formed plain concrete pile and the secant concrete pile; leveling the site and setting out lines for positioning; drilling a rotary jet grouting pile hole, and then inserting a grouting pipe to spray concrete grout after a drill is positioned.

Further, for sections with thick earth fill and poor self-stability, and bad geological area, screen pipes are added to strength grouting according to actual situation of excavation.

Further, in step 6, nozzle moves in a circular motion to make a surface of the sprayed layer flat and smooth; sprayed concrete is sprayed in two layers; when spraying, in layers, spraying of a latter layer is carried out for a setting time after a curing of a former layer of concrete; a shotcrete layer is formed after the spraying is, completed.

In the present disclosure, the unconstructed concrete pile is a secant concrete pile that was not constructed in time due to sudden reasons.

The beneficial effects of the present invention are as follows:

In the present disclosure, concrete is sprayed on the formed plain concrete piles. During the construction process, the connection between the Y-shaped connecting piece and the steel mesh sheet nodes is more secure and firm, and the U-shaped connecting piece makes the combination of the steel mesh sheet and the sprayed surface more closely. Double layers of steel mesh sheet are used to improve the impermeability and stability of concrete inside interface in secant pile construction. The reinforced, concrete pile is set outside and rotary jet grouting piles are added to interlock with the reinforced concrete pile. According to geological condition, screen pipes are added among the rotary jet grouting piles, the reinforced concrete pile and the secant pile to further improve the anti-seepage ability of the foundation pit.

Compared with prior art, the present disclosure has strong anti-leakage capability and high overall stability at the concrete inside interface of the secant pile, improves the safety of foundation pit support, reduces potential safety hazards, and is suitable for the concrete inside interface processing of subway foundation pit engineering and building foundation pit and has broad application prospects.

BRIEF DESCRIPTION OF THE DRAWINGS

The accompanying drawings forming a part of the present disclosure are used to assist a further understanding of the present disclosure, and the exemplary embodiments of the present disclosure and their descriptions are used to explain the present disclosure, and do not constitute an, improper limitation of the present disclosure.

FIG. 6 (*b*) is a rear view of the Y-shaped connecting piece in the present disclosure.

FIG. 6 (*c*) is a front view of the Y-shaped connecting piece in the present disclosure.

DETAILED DESCRIPTION OF PREFERRED EMBODIMENTS

Figure 1:
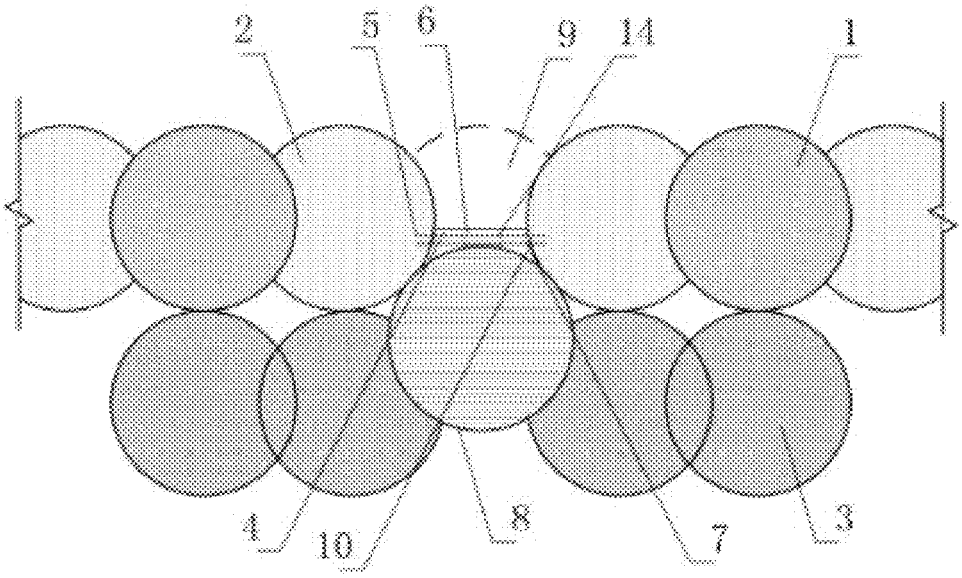
FIG. 1 is a schematic overall plan view of a concrete inside interface processing structure for secant pile construction in the present disclosure.
Figure 2:
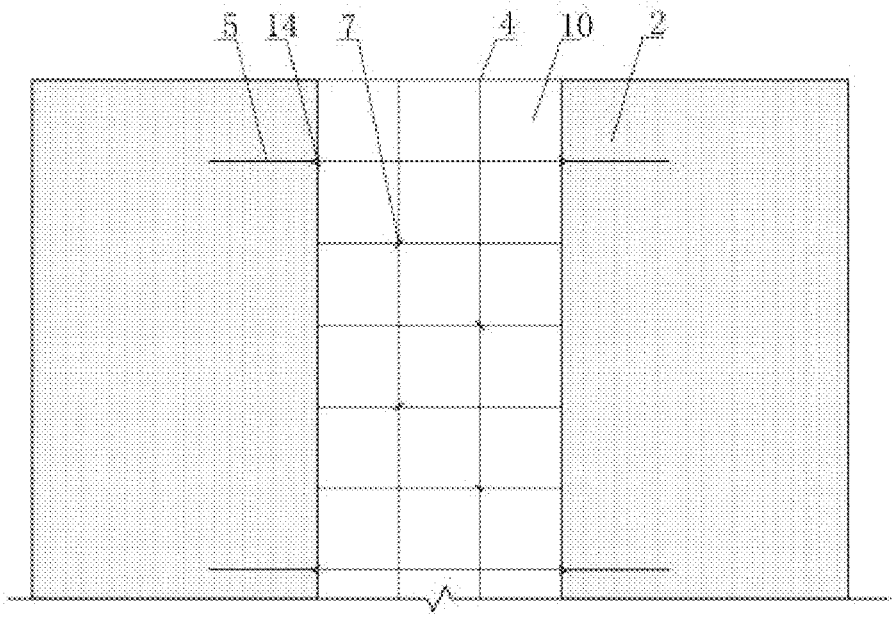
FIG. 2 is a schematic front view showing the installation of steel mesh sheet, between secant piles in the present disclosure.
Figure 3:
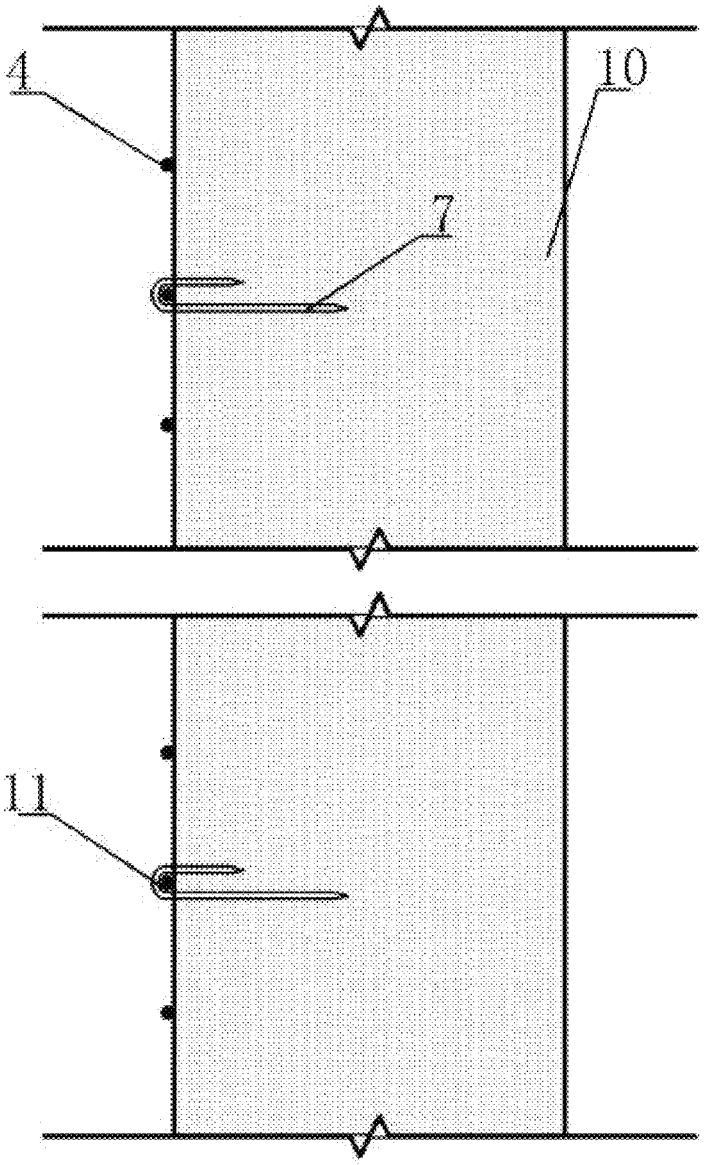
FIG. 3 is a detailed installation diagram of a Y-shaped connecting piece in the present disclosure.

It should be noted that the following detailed description is exemplary and intended to provide further explanation of the disclosure. Unless otherwise defined, all technical and scientific terms used herein have the same meaning as commonly understood by one of ordinary skill in the art to which this disclosure belongs.

It should be noted that the terms used here are only for describing specific embodiments, and are not intended to limit the exemplary embodiments according to the present disclosure. As used herein, unless the present disclosure clearly indicates otherwise, the singular form is also intended to include the plural form. In addition, it should also be understood that when the terms "comprising" and/or "including" are used in this specification, they indicate the existence of features, steps, operations, devices, components, and/or their combinations.

The present disclosure will be further described in detail below through embodiments and in conjunction with the accompanying drawings.

Embodiment 1

As shown in FIGS. 1-5, a concrete inside interface processing structure for secant pile construction in this embodiment includes a secant concrete pile 1, a formed plain concrete pile 2, a plurality of rotary jet grouting piles 3, a steel mesh sheet 4, a C18 ribbed steel bar 5, a concrete layer 6, a Y-shaped connecting piece 14, a reinforced concrete pile 8, soil body 10 between formed plain concrete piles, steel mesh sheet nodes 11, bar glue 12, welding points 13 of the Y-shaped connecting piece and ribbed steel bar, and a U-shaped connecting piece 7;

wherein, the C18 ribbed steel bar 5 is welded to a bottom of the Y-shaped connecting piece 14, and a welding position is the welding point 13 of the Y-shaped connecting piece and the ribbed steel bar.

Drilled holes are arranged at intervals along an axis of the plain concrete pile 2; the C18 ribbed, steel bar 5 is anchored in each drilled hole by the bar glue 12; the C18 ribbed steel bar 5 is connected to the steel mesh sheet nodes of the steel mesh sheet 4 by the Y-shaped connecting piece 14.

The steel mesh sheet 4 is formed by welding or bindingly connecting longitudinal bars 15 and transverse bars 16. Connection points between the longitudinal bars 15 and transverse bars 16 are the steel mesh sheet nodes 11.

The longitudinal bar 15 of the steel mesh sheet and the transverse bar 16 of the steel mesh sheet are connected by welding or binding to form the steel mesh sheet 4. The connection points between the longitudinal 15 of the steel mesh sheet and the transverse 16 of the steel mesh sheet are the steel mesh sheet nodes 11. There are multiple longitudinal bars 15 of the steel mesh sheet, and multiple transverse bars 16 of the steel mesh sheet, thus forming multiple steel mesh sheet nodes 11. Part of the plurality of steel mesh sheet nodes 11 located on both sides are connected with the Y-shaped connecting piece 14, and part of the plurality of steel mesh sheet nodes 11 in the middle are connected with the U-shaped connecting piece 7. Two sides of the steel mesh sheet 4 and the Y-shaped connecting piece 14 are respectively driven into the soil body 10 between the formed plain concrete piles, so that the steel mesh sheet 4 and the soil body 10 between formed plain concrete piles are firmly fixed, and the concrete layer 6 is formed by spraying concrete on the steel mesh sheet 4.

The outside of the two formed plain concrete piles 2 is cast with the reinforced concrete pile 8, and the reinforced concrete pile 8 is respectively tangent to the two formed plain concrete piles 2, and the reinforcement depth is an elevation from a ground to a bottom of the secant concrete pile; and the reinforced concrete pile 8 is interlocked with the two adjacent rotary jet grouting piles 3, and the rotary jet grouting piles 3 are tangent to the formed plain concrete piles 2, and a plurality of rotary jet grouting piles 3 are provided. The rotary jet grouting pile 3 located on the outside of the formed plain concrete pile 2 is tangent to the formed plain concrete pile 2; the rotary jet grouting pile 3 located on the outside of the secant concrete pile 1 is tangent to the secant concrete pile 1, and its reinforcement depth is an elevation from the ground to bottom of the secant concrete pile. A plurality of rotary jet grouting piles 3 are provided.

The diameter of the secant concrete pile 1 in this embodiment is determined to be more than 1000 mm according to the engineering geological conditions, and it is at least cast with C45 underwater concrete. An interlocking dimension between the formed plain concrete piles 2 and the secant concrete pile 1 is not less than 300 mm. Of course, it is not difficult to understand that in other embodiments, the diameter of the secant, concrete pile 1 and the interlocking dimension between the formed plain concrete pile 2 and the secant concrete pile 1 can be set according to the geological conditions of the actual project, and are not limited to the sizes disclosed in this embodiment.

The diameter of the formed plain concrete pile 2 is determined to be more than 1000 mm according to the engineering geological conditions, and it is at least cast with C25 ultra-retarding concrete. An interlocking dimension between the formed plain concrete pile 2 and the secant concrete pile 1 is not less than 300 mm. Of course, it is not difficult to understand that in other embodiments, the diameter of the formed plain concrete pile 2 and the interlocking dimension between the formed plain concrete pile 2 and the secant concrete pile 1 can be set according to the geological conditions of the actual project, and, are not limited to the sizes disclosed in this embodiment.

In this embodiment, the diameter of the rotary jet grouting pile 3 is the same as that of the secant concrete pile 1, and it is at least cast with an ordinary portland cement with a grade of 42.5. An interlocking dimension between the rotary jet grouting pile 3 and the reinforced concrete pile 8 is not less than 300 mm. Of course, it is not difficult to understand that in other embodiments, the diameter of the rotary jet grouting pile 3 and the interlocking dimension between the rotary jet grouting pile 3 and the reinforced concrete pile 8 can be set according to the geological conditions of the actual project, and are not limited to the size and material disclosed in this embodiment.

In this embodiment, the diameters of the longitudinal bars 15 of the steel mesh sheet and the transverse bars 16 of the steel mesh sheet are not less than 8 mm, the spacing between adjacent longitudinal bars 15 of the steel mesh sheet is not more than 200 mm, and the spacing between adjacent transverse bars 16 of the steel mesh sheet is not more than 200 mm; the diameter of the C18 ribbed steel bar 5 is at least 18 mm; the shotcrete layer 6 is at least cast with C20 cement, and with a thickness not less than 200 mm. Of course, it is not difficult to understand that in other embodiments, the sizes and spacings of the longitudinal bars 15 of the steel mesh sheet, the transverse bars 16 of the steel mesh sheet, and the C18 ribbed steel bars 5 can be set according to the geological conditions of the actual project, and are not limited to the sizes sand spacings disclosed in, this embodiment.

In this embodiment, the diameter of the reinforced concrete pile 8 is the same as that of the secant concrete pile 1 and the formed plain concrete pile 2, and it is cast with C45 underwater concrete. Of course, it is not difficult to understand that in other embodiments, the size and material of the reinforced concrete pile 8 can be set according, to the geological conditions of the actual project, and are not limited to the size and material disclosed in this embodiment.

Figure 6:
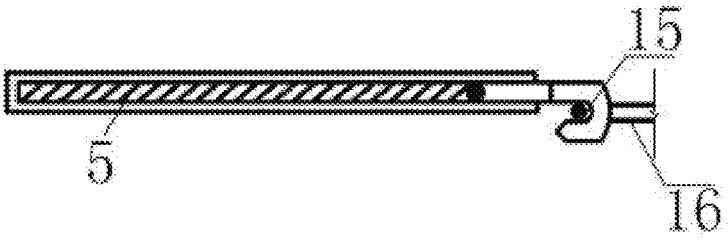
FIG. 6 (*a*) is a top view of the Y-shaped connecting piece in the present disclosure.
Figure 6:
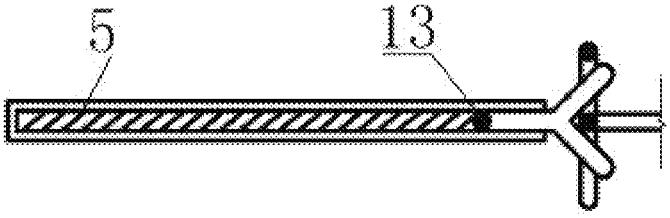
Figure 6:
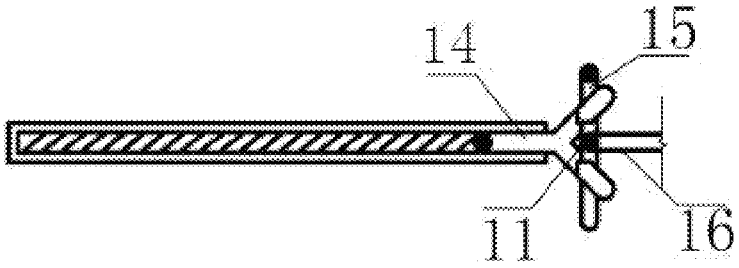

The structure of the Y-shaped connecting piece 14 in this embodiment is shown in FIG. 6(*a*), FIG. 6(*b*), and FIG. 6(*c*). Each of two branch ends (two ends with an acute angle) of the Y-shaped connecting piece 14 are provided with a hook, a bottom of the hook is welded to the steel mesh sheet 4. The two hooks are bent 180°, an inner diameter of the hook is slightly larger than that of the connected steel bar. An angle between the branch ends is 45°, a length of each hook is 100 mm. The Y-shaped connecting piece 14 has a a total length of 300 mm, and is made of smooth round steel bar with a diameter of not less than 18 mm. Of course, it is not difficult to understand that in other embodiments, the size and material of the Y-shaped connecting piece 14 can be set according to the geological conditions of the actual project, not limited to dimensions and materials disclosed in this embodiment.

Figure 4:
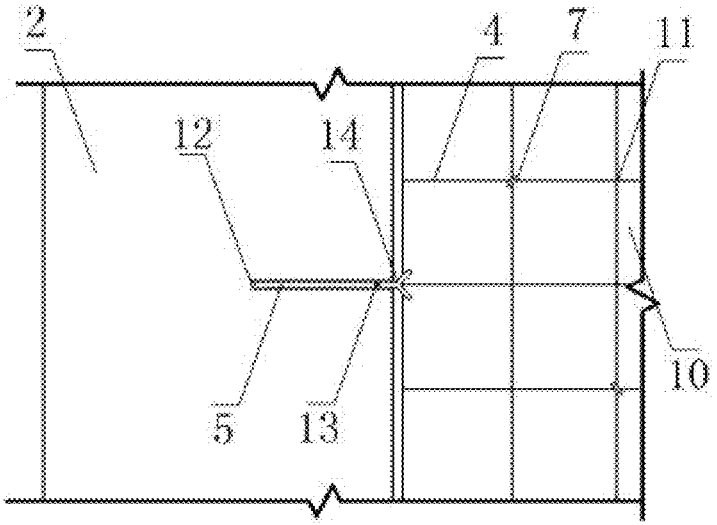
FIG. 4 and FIG. 5 are detailed installation views of a U-shaped connecting piece in the present disclosure.
Figure 5:
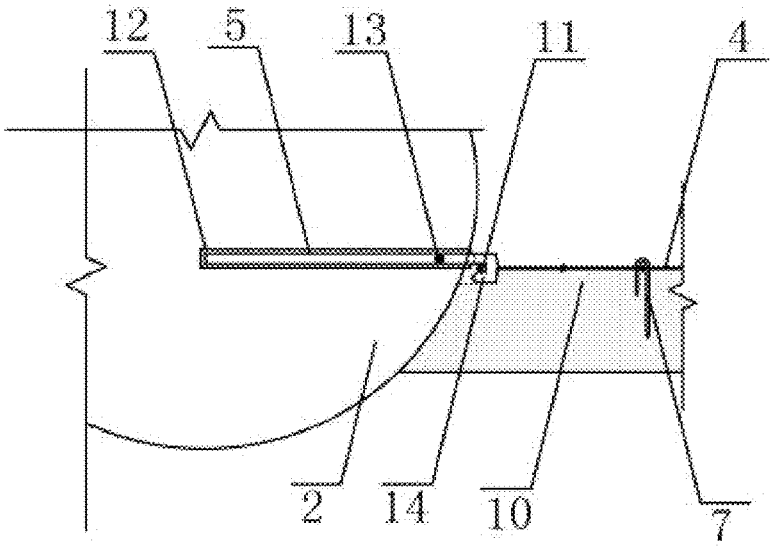

In this embodiment, as shown in FIG. 4 and FIG. 5, lengths of two sides of the U-shaped connecting piece 7 are unequal, one side has a length of 200 mm, and the other side has a length of 100 mm, and the two ends of the U-shaped connecting piece 7 are sharp ends. The inner diameter of a curved part of the U-shaped connecting piece 7 is slightly larger than the diameter of the connected steel bar. The U-shaped connecting piece 7 is made of circular ribbed steel bar with a diameter of not less than 12 mm. Of course, it is not difficult to understand that in other embodiments, the size and material of the U-shaped connecting piece 7 can be set according to, the geological conditions of the actual project, and are not limited to the size and material disclosed in this embodiment.

In this embodiment, the unconstructed concrete pile 9 in FIG. 1 is a secant concrete, pile that was not constructed in time due to sudden reasons.

Embodiment 2

In this embodiment, the structure described in embodiment 1 is applied in the construction process of a subway station. The main structure of the concrete inside interface processing structure for secant pile construction includes a 1000 mm secant concrete pile 1, a 1000 mm plain concrete pile 2, and a 1000 mm rotary jet grouting pile 3, 8 mm@200×200 mm steel mesh sheet 4, C18 ribbed steel bar 5, 200 mm thick C20 sprayed concrete layer 6, Y-shaped connecting piece 14, a 1000 mm reinforced concrete pile 8, a 1000 mm unconstructed concrete pile 9, the soil body 10 between formed plain concrete, piles, the steel mesh sheet nodes 11, the bar glue 12, the welding points 13 of the Y-shaped connecting piece and ribbed steel bar, the U-shaped connecting piece 7, the longitudinal bars 15 of steel mesh sheet, the transverse bars 16 of steel mesh sheet. The 8 mm@200×200 mm steel mesh sheet 4 in this embodiment means that the diameter of the steel bar is 8 mm, and the transverse bars and the longitudinal bars are arranged at intervals of 200 mm.

Each of the two branch ends of the Y-shaped connecting piece 14 is provided with a hook, the bottom of the hook is welded to the steel mesh sheet 4. The hook is bent 180°, an inner diameter of the hook is 15 mm. The angle between the branch ends is 45°, a length of the hook is 100 mm. The Y-shaped connecting piece 14 has a a total length of 300 mm, and is made of smooth round steel bars with a diameter of not less than 18 mm.

The two sides of the U-shaped connecting piece 7 are 200 mm and 100 mm in length respectively, the two ends of the U-shaped connecting piece 7 are sharp ends, the inner diameter of the curved part is 15 mm. The U-shaped connecting piece 7 is made of circular ribbed steel bar with a diameter of not less than 12 mm.

The C18 ribbed steel bar 5 is welded to the bottom of Y-shaped connecting piece 14, and bar glue is used on the formed plain concrete pile 2 to anchor the C18 ribbed steel bar with a vertical spacing of 1.0 m along the plain concrete pile 2, and an anchoring depth of 300 mm.

The sprayed surface is cleaned, the 8 mm@200×200 mm steel mesh sheet 4 is welded firmly. As shown in FIG. 5, the steel mesh sheet nodes 11 on two sides of the steel mesh sheet are connected to the Y-shaped connecting pieces 14 on two sides; and the U-shaped connecting piece 7 is connected to the steel mesh sheet nodes 11 in the middle, and driven into the soil body 10 between the formed plain concrete piles 2 to make the steel mesh sheet 4 and the soil body 10 firmly fixed. The C20 concrete 6 is sprayed to form 100 mm thick, concrete layer on the steel mesh sheet 4, and the bar glue 12 is used again on the formed plain concrete pile 2 to anchor the C18 ribbed steel bar with a vertical spacing of 1.0 m along the plain concrete pile 2, and an anchoring depth of 300 mm. The 8 mm@200×200 mm steel mesh sheet 4 is welded firmly. The steel mesh sheet nodes 11 on two sides of the steel mesh sheet are connected to the Y-shaped connecting pieces 14 on two sides. As shown in FIG. 5, the U-shaped connecting piece 7 is connected to the steel mesh sheet nodes 11 in the middle, and driven into the soil body 10 between the formed plain concrete piles 2 to make the steel mesh sheet 4 and the concrete layer 6 firmly fixed. The C20 concrete 6 is sprayed again to form 100 mm thick concrete layer on the steel mesh sheet 4. The reinforced concrete pile 8 is cast on the outside of the formed plain concrete piles 2, with a distance of 1000 mm from the formed plain concrete piles 2, and the reinforcement depth is an elevation from the ground to the bottom of the secant pile. The rotary jet grouting pile 3 is constructed to interlock with, the reinforced concrete pile 8 with a interlocking dimension of 300 mm. Distances between the rotary jet grouting pile 3 and the formed plain concrete piles 2 and the secant concrete pile 1 are 1000 mm respectively. The reinforcement depth is an elevation from the ground to the bottom elevation of the secant pile.

The specific implementation method of this embodiment is:

Step 1: cleaning up the sprayed surface; removing a loose part of the soil body at the interface between enclosure piles according to an excavation sequence of a foundation pit, after excavating each layer of soil between the formed plain concrete piles 2;

Step 2: drilling holes with a vertical spacing of 1.0 m and a depth of 360 mm on each formed plain concrete pile along each formed plain concrete piles 2; and welding the C18 ribbed steel bar 5 and the Y-shaped connecting piece 14 together and anchoring the C18 ribbed steel bar 5 and the Y-shaped connecting piece 14 by a mixed liquid of epoxy resin and EP type curing agent with a mass ratio of 2:1 to improve the anchoring effect;

Step 3: preparing the steel mesh sheet 4; wherein the 8 mm@200×200 mm steel mesh sheet 4 is prepared in advance, which is convenient for direct welding and, installation on site; the overlapping length between the steel mesh sheets is 200 mm, and the the steel mesh sheets are firmly welded;

Step 4: installing the steel mesh sheets 4; the sprayed surface is ensured flat before hanging the steel mesh sheets, and the nodes on both sides of the steel mesh sheet are hanged to the two hooks of the Y-shaped connecting piece 14 to make the connection firm;

Step 5: driving the U-shaped connecting piece 7 into the sprayed surface after the U-shaped connecting piece 7 is connected with the middle nodes of the steel mesh sheet to firmly, fix the steel mesh sheet 4;

Step 6: spraying concrete; wherein the spraying operation is carried out in sections, zones and layers from top to bottom in sequence; the nozzle makes a small circular motion, the distance between the spray gun and the base surface is about 1.0 m, and the working wind pressure is 3 Mpa, so that the surface of the spraying layer is flat and smooth; sprayed concrete is sprayed in two layers, the first layer has a thickness of 30-50 mm, and the second layer is sprayed to a design thickness of 100 mm; when spraying in layers, the spraying of the second layer should be carried out 1 hour after the solidification of the first layer of concrete;

Step 7: repeating steps 2 to 6; wherein double layers of 8 mm@200×200 mm steel mesh sheets 4 are used between the formed plain concrete piles 2, the C20 concrete is sprayed in layers, and a 200 mm thick concrete layer 6 is finally formed;

Step 8: constructing the reinforced concrete pile 8; wherein the diameter of the reinforced concrete pile 8 is 1000 mm, and it is cast with C45 underwater concrete; first, the site is leveled and the line is set out for positioning; in order to improve the positioning accuracy of the hole of the secant pile and improve the efficiency of positioning, a concrete guide wall is constructed on the top of the reinforced concrete pile; after the strength of the concrete guide wall reaches 80% of the required strength, a drilling machine is in place, and then the soil is removed to form a pile hole; after that, the reinforcement cage is placed into the pile hole, the C45 underwater concrete is cast, and the pipe is pulled out to complete a construction of the pile hole;

Step 9: constructing of the rotary jet grouting pile 3; four 1000 mm rotary jet grouting piles are added on both sides of the reinforced concrete pile 8; the rotary jet grouting pile and the reinforced concrete pile 8 are interlocked by 300 mm, and the distance between the rotary jet grouting pile 3 and the formed secant pile is 1000 mm; first, the site is leveled and the line is set out for positioning; a rotary jet grouting pile hole is drilled; after a drill is positioned, a grouting pipe is inserted to spray concrete grout.

The above descriptions are only preferred embodiments of the present disclosure, and are not intended to limit the present disclosure. For those skilled in the art, the present disclosure may have various modifications and changes. Any modification, equivalent replacement, improvement, etc. made within the spirit and principle of the present disclosure shall be included within the protection scope of the present disclosure.

The invention claimed is:

1. A concrete inside interface processing structure for secant pile construction, comprising a secant concrete pile, a formed plain concrete pile, a plurality of rotary jet grouting piles, a steel mesh sheet, a ribbed steel bar, a concrete layer, a Y-shaped connecting piece, a reinforced concrete pile, and a U-shaped connecting piece; wherein drilled holes are arranged at intervals along an axis of the formed plain concrete pile; the ribbed steel bar is anchored in each drilled hole: the steel mesh sheet is formed by connecting longitudinal bars and transverse bars, connection joints between the longitudinal bars and transverse bars are steel mesh sheet nodes; steel mesh sheet, nodes located on both sides of the steel mesh sheet are connected with the ribbed steel bar by the Y-shaped connecting piece, and steel mesh sheet nodes in middle of the steel mesh sheet are connected with the U-shaped connecting piece; the steel mesh sheet is driven into a soil body between the formed plain concrete piles, and the concrete layer is formed by spraying concrete on the steel mesh sheet; the reinforced concrete pile is cast at an outside of the formed plain concrete pile; and the reinforced concrete pile is tangent to the formed plain concrete pile, and the reinforced concrete pile is interlocked with the rotary jet grouting piles; the plurality of rotary jet grouting piles are tangent to the formed plain concrete pile or the secant concrete pile.

2. The concrete inside interface processing structure for secant pile construction according to claim 1, wherein each of two branch ends of the Y-shaped connecting piece is provided with a hook, the two hooks are bent 180° to same side, an inner diameter of the hook is slightly larger than that of the ribbed steel bar connected; an angle between the two branch ends is 45°.

3. The concrete inside interface processing structure for secant pile construction according to claim 1, wherein the drilled holes are evenly arranged along a length direction of the formed plain concrete pile.

4. The concrete inside interface processing structure for secant pile construction according to claim 1, wherein lengths of two sides of the U-shaped connecting piece are unequal, two ends of the U-shaped connecting, piece are sharp ends, and an inner diameter of a curved part of the U-shaped connecting piece is slightly larger than that of the ribbed steel bar connected.

5. The concrete inside interface processing structure for secant pile construction according to claim 1, wherein a diameter of the rotary jet grouting pile is same as that of the secant concrete pile.

6. The concrete inside interface processing structure for secant pile construction according to claim 1, wherein a reinforcement depth of the rotary jet grouting pile is an elevation from a ground to a bottom of the secant concrete pile.

7. The concrete inside interface processing structure for secant pile construction according to claim 1, wherein a reinforcement depth of the reinforced concrete pile is an elevation from a ground to a bottom of the secant concrete pile.

8. A processing method of concrete inside interface in secant pile construction, comprising:

step 1: cleaning up a sprayed surface; removing a loose part of a soil body at an interface between enclosure piles according to an excavation sequence of a foundation pit, after excavating each layer of soil between formed plain concrete piles;

step 2: drilling holes with a vertical spacing on each formed plain concrete pile along an axis direction of each formed plain concrete pile; welding a ribbed steel bar and a Y-shaped connecting piece together and anchoring the ribbed steel bar and the Y-shaped connecting piece on the formed plain concrete piles by a bar glue;

step 3: preparing a steel mesh sheet;

step 4: installing the steel mesh sheet; wherein the sprayed surface is ensured flat before hanging the steel mesh sheet, and steel mesh sheet nodes on both sides of the steel mesh sheet are hanged to two hooks of the Y-shaped connecting piece to make a connection of the steel mesh sheet and the Y-shaped connecting piece firm;

step 5: driving a U-shaped connecting, piece into the sprayed surface after the U-shaped connecting piece is connected with middle nodes of the steel mesh sheet to firmly fix the steel mesh sheet to the soil body between the formed plain concrete piles;

step 6: spraying concrete; wherein spraying operation is carried out in sections, zones and layers from top, to bottom in sequence;

step 7: repeating steps 2 to 6; wherein double layers of steel mesh sheet are used between the formed plain concrete piles, the concrete is sprayed in layers, and a concrete layer is finally formed;

step 8: constructing a reinforced concrete pile; leveling a site and setting out lines for positioning; constructing a concrete guide wall on a top of the reinforced concrete pile; positioning a drilling machine after a strength of the concrete guide wall meets a requirement; removing soil to form a pile hole and placing a steel reinforcement cage into the pile hole; grouting concrete by grouting pipe, and pulling out the grouting pipe to complete a construction of the pile hole;

step 9: constructing of rotary jet grouting piles; adding four rotary jet grouting piles with same diameter as the reinforced concrete pile on both sides of the reinforced concrete pile; wherein the rotary jet grouting piles interlock with the reinforced concrete pile and are tangent to the formed plain concrete pile and the secant concrete pile; leveling the site and setting out lines for positioning; drilling a rotary jet grouting pile hole, and then inserting a grouting pipe to spray concrete grout after a drill is positioned.

9. The processing method of concrete inside interface in secant pile construction of claim 8, wherein for sections with thick earth fill and poor self-stability, and bad geological area, screen pipes are added to strength grouting according to actual situation of excavation.

10. The processing method of concrete inside interface in secant pile construction of claim 8, wherein in step 6, nozzle moves in a circular motion to make a surface of the sprayed layer flat and smooth; sprayed concrete is sprayed in two layers; when spraying in layers, spraying of a latter layer is carried out for a setting time after a curing of a former layer of concrete; a shotcrete layer is formed after the spraying is completed.

* * * * *